US009246231B2

(12) United States Patent
Ju

(10) Patent No.: US 9,246,231 B2
(45) Date of Patent: Jan. 26, 2016

(54) HIGH-GAIN WIDEBAND ANTENNA APPARATUS

(71) Applicant: ELECTRONICS AND TELECOMMUNICATIONS RESEARCH INSTITUTE, Daejeon (KR)

(72) Inventor: JeongHo Ju, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 150 days.

(21) Appl. No.: 13/746,384

(22) Filed: Jan. 22, 2013

(65) Prior Publication Data

US 2013/0222200 A1 Aug. 29, 2013

(30) Foreign Application Priority Data

Feb. 27, 2012 (KR) ..... 10-2012-0019956

(51) Int. Cl.
*H01Q 15/02* (2006.01)
*H01Q 1/42* (2006.01)
*H01Q 15/00* (2006.01)

(52) U.S. Cl.
CPC ..... *H01Q 15/02* (2013.01); *H01Q 1/425* (2013.01); *H01Q 15/0013* (2013.01); *H01Q 15/0053* (2013.01)

(58) Field of Classification Search
USPC ..... 343/700 MS, 872, 833, 909
See application file for complete search history.

(56) References Cited

U.S. PATENT DOCUMENTS

| | | | | |
|---|---|---|---|---|
| 5,892,485 | A * | 4/1999 | Glabe et al. | 343/789 |
| 6,342,866 | B1 * | 1/2002 | Ho et al. | 343/795 |
| 7,319,429 | B2 | 1/2008 | Chang et al. | |
| 7,463,213 | B2 | 12/2008 | Nakano et al. | |
| 7,884,778 | B2 * | 2/2011 | Wu et al. | 343/872 |
| 2003/0184497 | A1 * | 10/2003 | Ye et al. | 343/909 |

(Continued)

FOREIGN PATENT DOCUMENTS

| | | | |
|---|---|---|---|
| JP | 2007-143132 | A | 6/2007 |
| JP | 1020100118889 | A | 11/2010 |
| KR | 20100118889 | A | 11/2010 |

OTHER PUBLICATIONS

A.P. Feresidis, et al; "A Broadband High-Gain Resonant Cavity Antenna with Single Feed", Proc. EuCAP2006, Nice, France; Nov. 6-10, 2006, 5 pages.

(Continued)

*Primary Examiner* — Tan Ho
(74) *Attorney, Agent, or Firm* — Ladas & Parry LLP

(57) ABSTRACT

Disclosed is a high-gain wideband antenna apparatus. The high-gain wideband antenna apparatus, includes: a feeding antenna configured to radiate a signal; a cover configured to be disposed on a front surface of the feeding antenna based on a radiation direction of the signal and including a conductor pattern formed in a specific shape; and a ground surface configured to be disposed on the feeding antenna based on the radiation direction of the signal. By this configuration, the conductor patterns are approximately configured on both surfaces of a dielectric material to control a phase of a reflection coefficient in a specific frequency band, thereby increasing a gain and a bandwidth of an antenna and metal surfaces are additionally mounted on sides of a feeding antenna, thereby improving a front back ratio of the antenna.

19 Claims, 9 Drawing Sheets

(56) References Cited

U.S. PATENT DOCUMENTS

| | | | | |
|---|---|---|---|---|
| 2007/0200788 | A1 | 8/2007 | Nakano et al. | |
| 2010/0277374 | A1 | 11/2010 | Ju et al. | |
| 2014/0009346 | A1 * | 1/2014 | Anderson et al. | 343/705 |

OTHER PUBLICATIONS

L. Moustafa, et al; "EBG Structure With Wide Defect Band for Broadband Cavity Antenna Applications", IEEE Antennas and Wireless Propagation Letters, vol. 7, First published Nov. 7, 2008; Current version published Jan. 16, 2009. pp. 693-696.

* cited by examiner (a)

(b)

HIGH-GAIN WIDEBAND ANTENNA APPARATUS

CROSS-REFERENCES TO RELATED APPLICATIONS

The present application claims priority under 35 U.S.C 119(a) to Korean Application No. 10-2012-0019956, filed on Feb. 27, 2012, in the Korean Intellectual Property Office, which is incorporated herein by reference in its entirety set forth in full.

BACKGROUND

Exemplary embodiments of the present invention relates to a high-gain wideband antenna apparatus, and more particularly, to a high-gain wideband antenna apparatus capable of controlling a phase and a magnitude of a reflection coefficient by including a cover in which conductor patterns having a specific shape are arranged on both surfaces of a dielectric material.

Generally, an antenna, which is an essential apparatus for transmitting and receiving a signal in a wireless communication system, is resonated with an electromagnetic wave of a specific frequency to transmit and receive an electromagnetic signal of a corresponding frequency.

Recently, with the rapid development of the wireless communication system, a use of the antenna has been diversified. Further, various methods for improving a gain and characteristics of the antenna have been proposed.

As a method for improving the gain of the antenna, a method for improving the gain of the antenna while an electromagnetic wave from the antenna being resonated in a resonator by disposing a feeding apparatus of the antenna in a Fabry-Perot resonator has been proposed.

The Fabry-Perot resonator type antenna can improve the gain of the antenna, but has a too narrow bandwidth and thus, cannot be easily applied for transmission and reception of a wideband signal.

As the related art, there is US Patent Laid-Open No. 2007/0200788 (Publication in Aug. 30, 2007: Antenna Unit Having A Single Antenna Element And A Periodic Structure Upper Plate).

The above-mentioned technical configuration is a background art for helping understanding of the present invention and does not mean related arts well known in a technical field to which the present invention pertains.

SUMMARY

An embodiment of the present invention is directed to a high-gain wideband antenna apparatus capable of increasing a gain and a bandwidth of an antenna by controlling a phase and a magnitude of a reflection coefficient by arranging conductor patterns having a specific shape on both surfaces of a dielectric material.

In addition, an embodiment of the present invention is directed to a high-gain wideband antenna apparatus having a high front back ratio by mounting metal wall surfaces around an antenna.

An embodiment of the present invention relates to a high-gain wideband antenna apparatus, including: a feeding antenna configured to radiate a signal; a cover configured to be disposed on a front surface of the feeding antenna based on a radiation direction of the signal and including a conductor pattern formed in a specific shape; and a ground surface configured to be disposed on a rear surface of the feeding antenna based on the radiation direction of the signal.

The conductor patterns may be formed in different shapes on top and bottom surfaces of a dielectric substrate configuring the cover.

The conductor patterns may be formed by repeatedly arranging preset unit cells.

The conductor patterns may be formed by non-uniformly arranging the sizes of the unit cells.

The high-gain wideband antenna apparatus may further include: metal wall surfaces disposed at sides of the feeding antenna based on a radiation direction of the signal.

Another embodiment of the present invention relates to a high-gain wideband antenna apparatus, including: a feeding antenna configured to radiate a signal; and covers each disposed on front and back surfaces of the feeding antenna based on a radiation direction of the signal and each including conductor patterns formed in a specific shape.

An embodiment of the present invention relates to a high-gain wideband antenna apparatus, including: a cylindrical cover configured to include conductor patterns formed in a specific shape; and a feeding antenna configured to be disposed in the cylindrical cover and radiate a signal toward the conductor patterns.

The conductor patterns may be each formed in different shapes on inner and outer surfaces of a cylindrical dielectric substrate configuring the cover.

An embodiment of the present invention relates to a high-gain wideband antenna apparatus, including: a cylindrical cover configured to include conductor patterns formed in a specific shape; a plurality of feeding antennas configured to be each disposed in a plurality of areas partitioned in the cover to radiate a signal toward the conductor patterns; and a ground surface configured to be positioned at a central area common to the plurality of areas.

BRIEF DESCRIPTION OF THE DRAWINGS

The above and other aspects, features and other advantages will be more clearly understood from the following detailed description taken in conjunction with the accompanying drawings, in which.

DESCRIPTION OF SPECIFIC EMBODIMENTS

Figure 1:
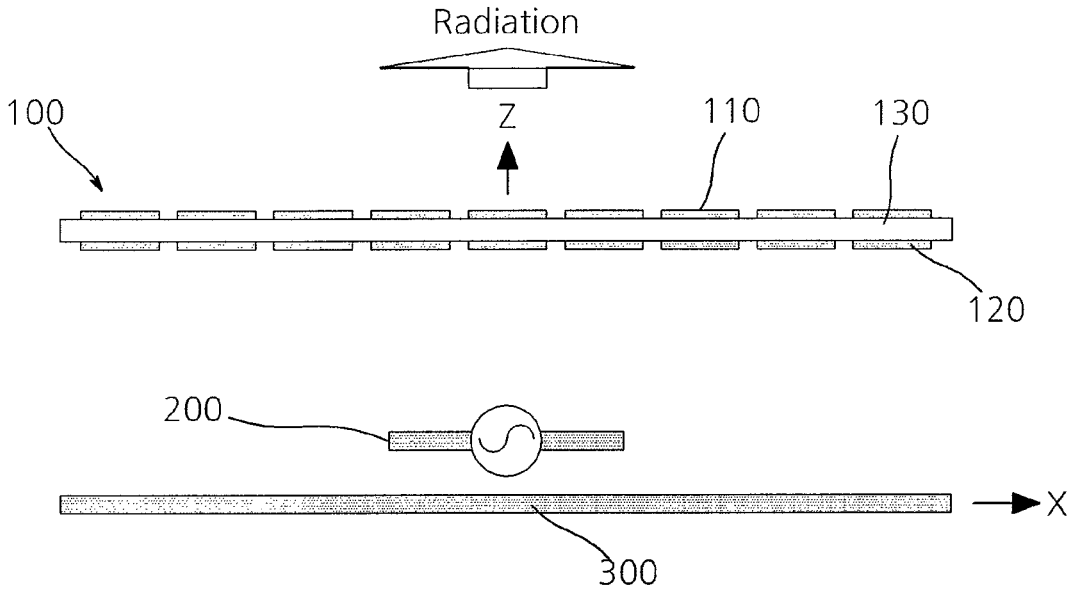
FIG. 1 is a diagram illustrating a structure of a high-gain wideband antenna apparatus in accordance with a first embodiment of the present invention.

Hereinafter, a high-gain wideband antenna apparatus in accordance with embodiments of the present invention will be described with reference to the accompanying drawings. During the process, a thickness of lines, a size of components, or the like, illustrated in the drawings may be exaggeratedly illustrated for clearness and convenience of explanation. Further, the following terminologies are defined in consideration of the functions in the present invention and may be construed in different ways by intention or practice of users and operators. Therefore, the definitions of terms used in the present description should be construed based on the contents throughout the specification.

FIG. 1 is a diagram illustrating a structure of a high-gain wideband antenna apparatus in accordance with a first embodiment of the present invention.

As illustrated in FIG. 1, a high-gain wideband antenna apparatus in accordance with a first embodiment of the present invention includes a cover 100, a feeding antenna 200, and a ground surface 300.

In this case, the high-gain wideband antenna apparatus in accordance with the embodiment of the present invention may further include metal wall surfaces 400 that are disposed at sides of the feeding antenna 200 based on a radiation direction of a signal so as to improve a front back ration (FBF) of an antenna.

Figure 2:
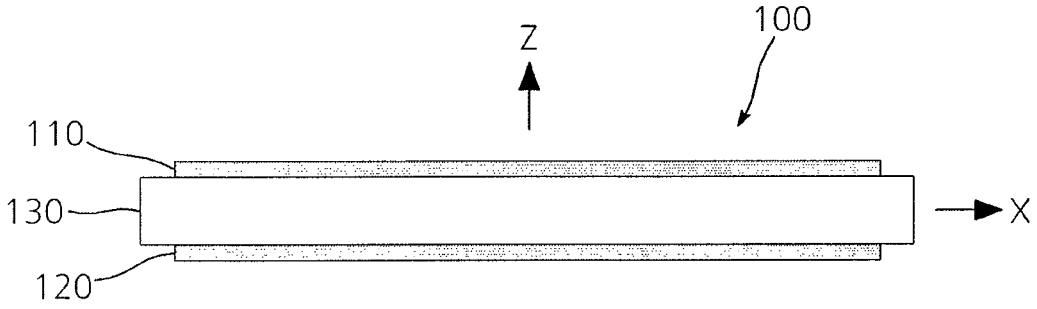
FIG. 2 is a side view illustrating a cover of the high-gain wideband antenna apparatus in accordance with the first embodiment of the present invention.
Figure 3:
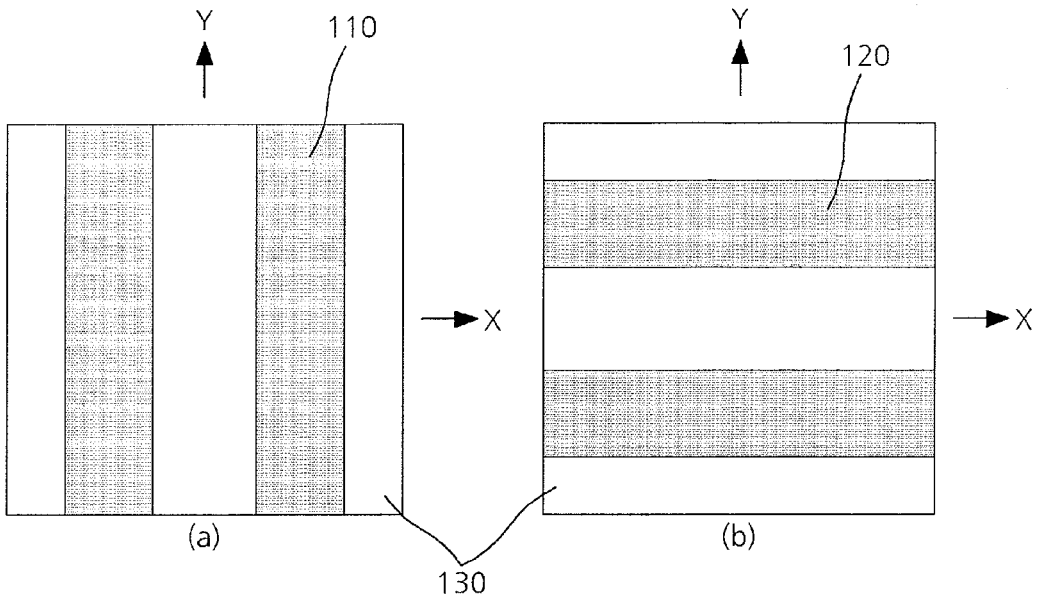
FIGS. 3A and 3B are exemplified diagrams of unit cells configuring conductor patterns on both surfaces of the cover of the high-gain wideband antenna apparatus in accordance with the first embodiment of the present invention.

FIG. 2 is a side view illustrating a cover of the high-gain wideband antenna apparatus in accordance with the first embodiment of the present invention and FIG. 3A and 3B are exemplified diagrams of unit cells configuring conductor patterns on both surfaces of the cover of the high-gain wideband antenna apparatus in accordance with the first embodiment of the present invention.

Figure 4:
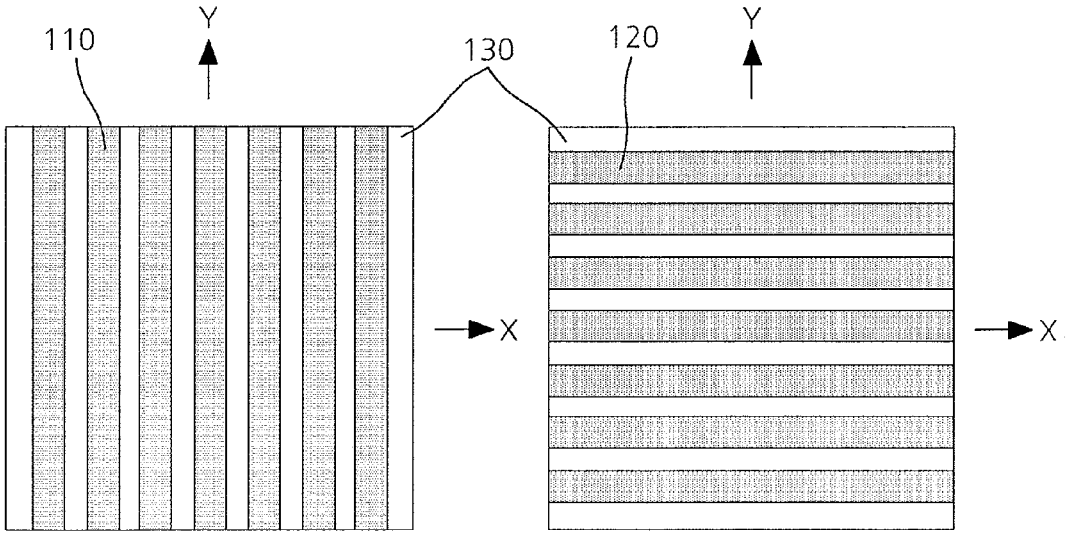
FIG. 4 is an exemplified diagram in which the conductor patterns are uniformly arranged on both surfaces of the cover of the high-gain wideband antenna apparatus in accordance with the first embodiment of the present invention.
Figure 5:
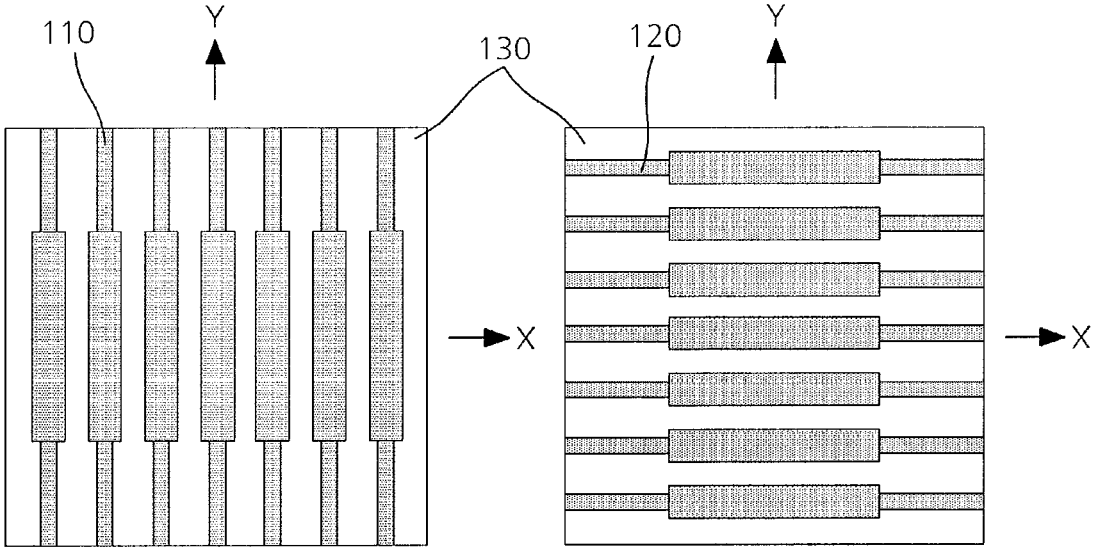
FIG. 5 is an exemplified diagram in which the conductor patterns are non-uniformly arranged on both surfaces of the cover of the high-gain wideband antenna apparatus in accordance with the first embodiment of the present invention.

In addition, FIG. 4 is an exemplified diagram in which the conductor patterns are uniformly arranged on both surfaces of the cover of the high-gain wideband antenna apparatus in accordance with the first embodiment of the present invention and FIG. 5 is an exemplified diagram in which the conductor patterns are non-uniformly arranged on both surfaces of the cover of the high-gain wideband antenna apparatus in accordance with the first embodiment of the present invention.

Figure 6:
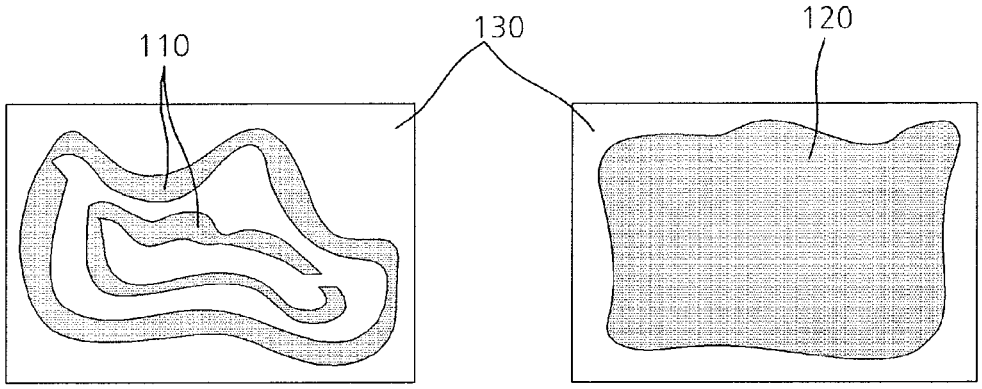
FIGS. 6A and 6B are various exemplified diagrams of the unit cells configuring the conductor patterns on both surfaces of the cover of the high-gain wideband antenna apparatus in accordance with the first embodiment of the present invention.
Figure 6:
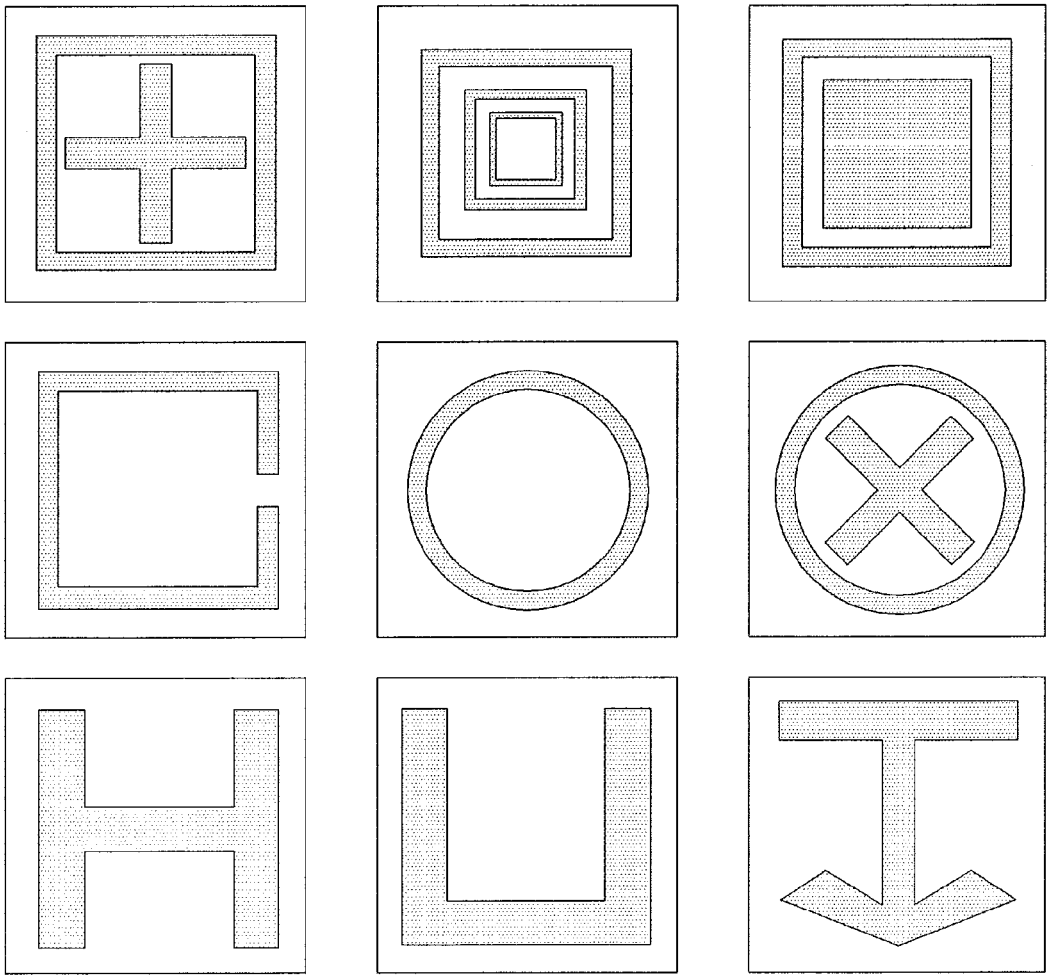

In addition, FIGS. 6A and 6B are various exemplified diagrams of the unit cells configuring the conductor patterns on both surfaces of the cover of the high-gain wideband antenna apparatus in accordance with the first embodiment of the present invention.

As illustrated in FIG. 2, the cover 100 includes a dielectric substrate 130 formed of a general dielectric material and conductor patterns 110 and 120 that are formed on top and bottom surface of the dielectric substrate 130.

In this configuration, the conductive patterns 110 and 120 include a top conductor pattern 110 that is formed on a top surface of the dielectric substrate 130 and a bottom conductor pattern 120 that is formed on a bottom surface of the dielectric substrate 130.

The conductive patterns 110 and 120 may be formed by repeatedly arranging unit cells having a preset specific shape in x and y-axis directions, wherein the top conductor pattern 110 and the bottom conductor pattern 120 may be formed in different shapes.

In detail, the top conductor pattern 110 may be formed by repeatedly arranging the unit cells having a shape illustrated in FIG. 3A in the x and y-axis directions and the bottom conductor pattern 120 may be formed by repeatedly arranging the unit cells having a shape illustrated in FIG. 3B in the x and y-axis directions.

As illustrated in FIG. 4, the top conductor pattern 110 and the bottom conductor pattern 120 may be uniformly formed by making the size of the unit cells configuring each pattern equal to each other.

On the other hand, as illustrated in FIG. 5, the top conductor pattern 110 and the bottom conductor pattern 120 may also be uniformly formed by using the unit cells of different sizes.

As described above, the case in which the conductor patterns 110 and 120 of the cover 100 are non-uniformly formed exhibits more excellent performance than the case in which the conductor patterns 110 and 120 of the cover 100 are uniformly formed, which can be confirmed in FIG. 10 to be described below.

Meanwhile, FIGS. 2 to 5 illustrates, for example, when the shape of the unit cells configuring the conductor patterns 110 and 120 is a rectangular patch shape in an x-axis direction or a y-axis direction, but the shape or the size of the unit cell may be variously selected according to designer's intention, system specification, values such as the magnitude or the phase of the reflection coefficient to be generated, and the like.

For example, the unit cells configuring the conductor patterns 110 and 120 of the cover 100 are implemented in various shapes as illustrated in FIGS. 6A and 6B and thus, the magnitude, phase, or bandwidth characteristics of the reflection coefficient can be appropriately controlled.

Figure 7:
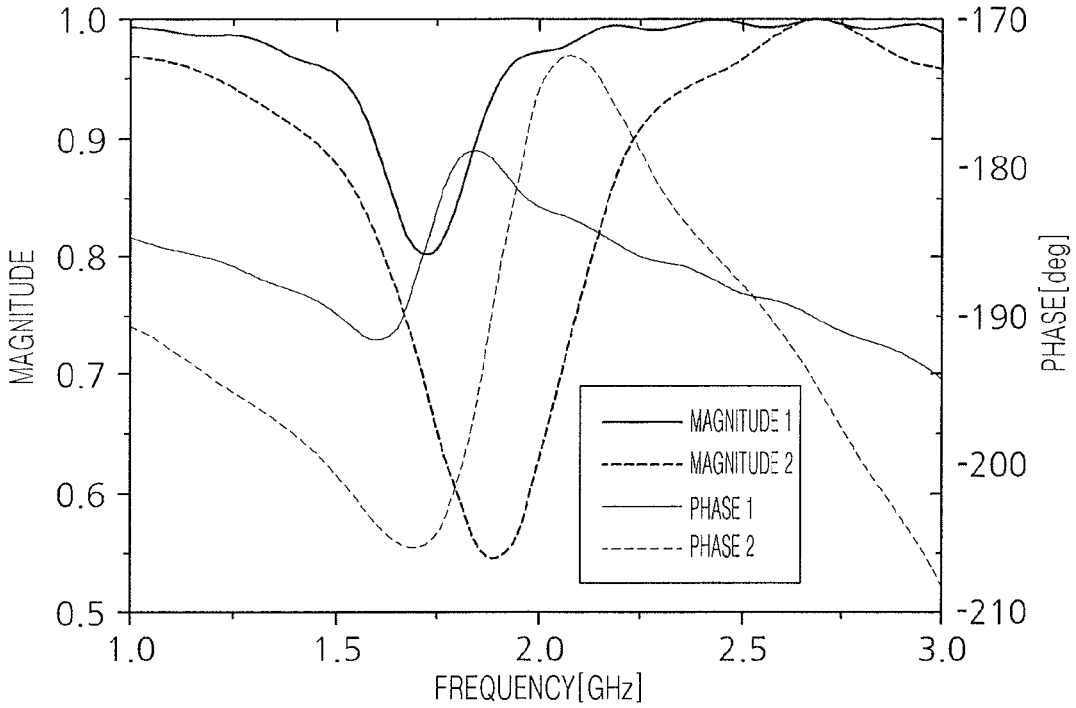
FIG. 7 is a graph illustrating reflection characteristics when a plane wave is incident to the cover of the high-gain wideband antenna apparatus in accordance with the first embodiment of the present invention.

FIG. 7 is a graph illustrating reflection characteristics when a plane wave is incident to the cover of the high-gain wideband antenna apparatus in accordance with the first embodiment of the present invention.

Referring to FIG. 7, it can be appreciated that a slope of the reflection coefficient has a negative value over the overall frequency band and has a positive value in the vicinity of the operating frequency.

This coincides with the case in which characteristics of an ideal phase satisfying wideband resonance conditions have a positive slope, but the value of the reflective coefficient is has a value of 1 or less. Therefore, when being applied to the Fabry-Perot resonator antenna, it can be appreciated that the gain may be slightly smaller than the case in which the reflective coefficient is 1 but the wideband characteristics may be provided together with a relatively high gain.

Meanwhile, in accordance with the embodiment of the present invention, a distance between two conductor patterns 110 and 111 that are formed on the top and bottom surfaces of the dielectric substrate 130 of the cover 100 is set to be a thickness of about 1/100 of a wavelength. However, the thickness of the dielectric substrate 130 may be implemented thicker or thinner according to the width of the targeted frequency band for implementing the wideband or the targeted magnitude and phase of the reflection coefficient.

That is, the magnitude and phase, bandwidth characteristics, frequency indicating the characteristics, and the like, of the reflection coefficient can be controlled by appropriately selecting the shape or the size of the conductor patterns 110 and 120 formed on the top and bottom surfaces of the dielectric substrate 130 and the thickness of the dielectric substrate 130.

In addition, the magnitude and phase, bandwidth characteristics, frequency indicating the characteristics, and the like, of the reflection coefficient may also be controlled by appropriately selecting a permittivity of the dielectric substrate 130.

The feeding antenna 200, which is an antennal radiating a signal, may include various antennas such as a patch antenna, a dipole antenna, a slot antenna, a waveguide antenna, and the like, that can feed a signal.

In this case, the above-mentioned cover 100 is disposed a front surface of the feeding antenna based on a radiation direction of a signal radiated from the feeding antenna 200 and the signal radiated from the feeding antenna 200 is radiated toward the conductor patterns 110 and 120 of the cover 100.

The ground surface 300 is disposed on a back surface of the feeding antenna 200 based on the radiation direction of the signal radiated from the feeding antenna 200 to ground the feeding antenna 200.

Figure 8:
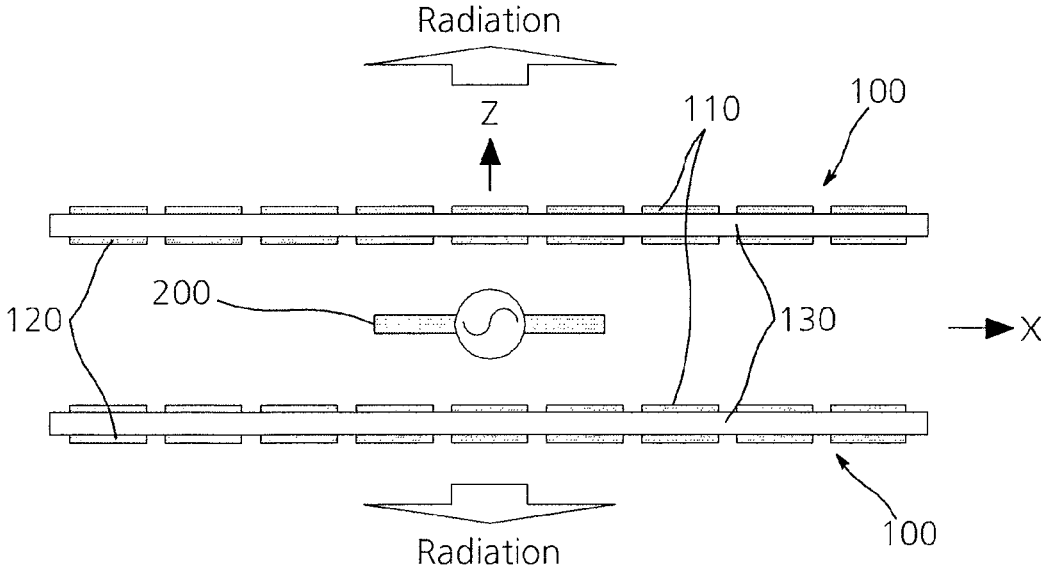
FIG. 8 is a diagram illustrating a structure of a high-gain wideband antenna apparatus in accordance with a second embodiment of the present invention.

FIG. 8 is a diagram illustrating a structure of a high-gain wideband antenna apparatus in accordance with a second embodiment of the present invention.

The first embodiment of the present invention as described above describes, for example, when the high-gain wideband antenna apparatus includes the ground surface 300 disposed on the back surface of the feeding antenna 200 based on the radiation direction of the signal.

However, the high-gain wideband antenna apparatus in accordance with the embodiment of the present invention may be implemented to include the extra cover 100 instead of the ground surface 300.

That is, the high-gain wideband antenna apparatus in accordance with the embodiment of the present invention may include a plurality of covers 100 that includes the conductor patterns 110 and 120 formed on the top and bottom surfaces of the dielectric substrate 130 and the feeding antenna 200 that is disposed between the plurality of covers 100 to radiate the signal toward the plurality of conductor patterns 110 and 120 provided on the plurality of covers 100.

In the above configuration, it is possible to more increase the gain and bandwidth of the antenna.

Figure 9:
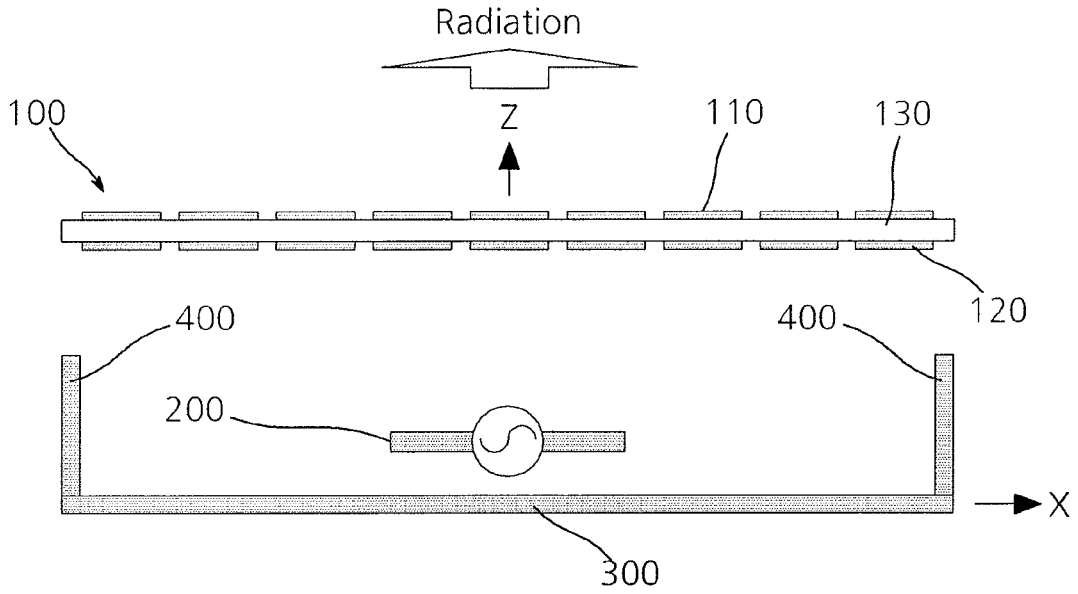
FIG. 9 is a diagram illustrating a structure of a high-gain wideband antenna apparatus in accordance with a third embodiment of the present invention.
Figure 10:
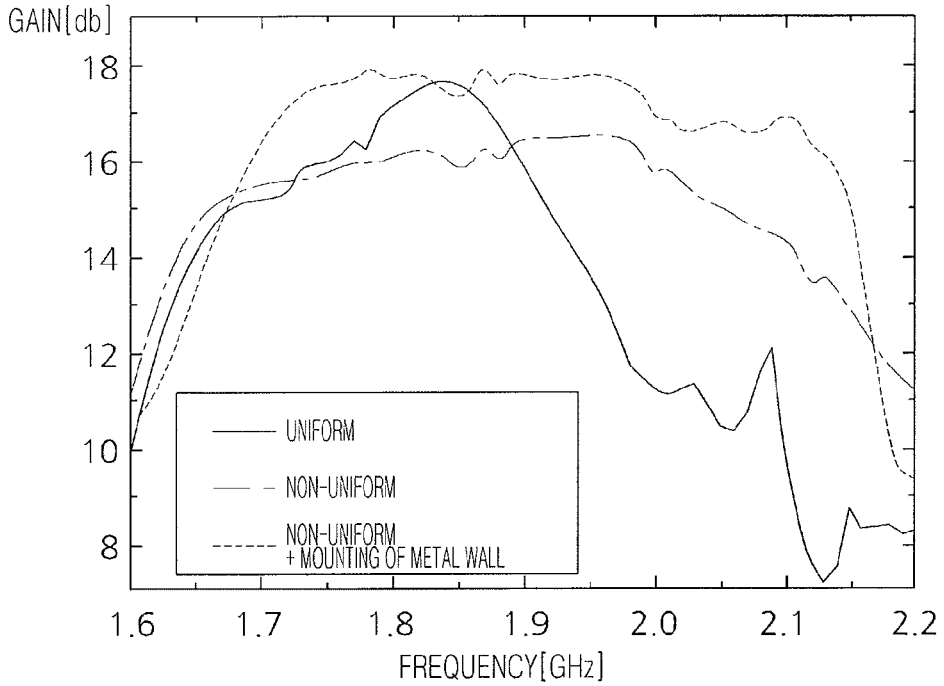
FIG. 10 is a graph illustrating a change in an antenna gain when metal wall surfaces are mounted as illustrated in FIG. 9.
Figure 11:
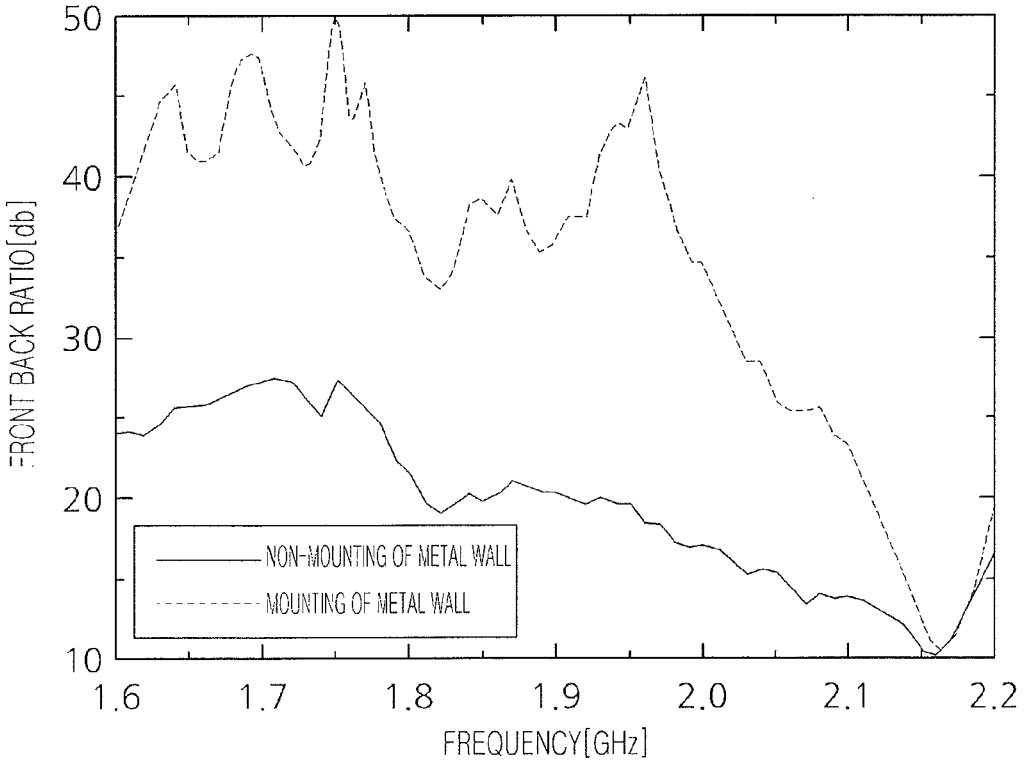
FIG. 11 is a graph illustrating a change in an antenna front back ratio when the metal wall surfaces are mounted as illustrated in FIG. 9.

FIG. 9 is a diagram illustrating a structure of a high-gain wideband antenna apparatus in accordance with a third embodiment of the present invention, FIG. 10 is a graph illustrating a change in an antenna gain when metal wall surfaces are mounted as illustrated in FIG. 9, and FIG. 11 is a graph illustrating a change in an antenna front back ratio when the metal wall surfaces are mounted as illustrated in FIG. 9.

Unlike the first and second embodiments as described above, the high-gain wideband antennal apparatus in accordance with the present invention may further include metal surfaces 400 that are disposed at the sides of the feeding antenna 200 based on the radiation direction of the signal as illustrated in FIG. 9.

Referring to FIG. 10, it can be appreciated that the case in which the conductor patterns 110 and 120 of the cover 100 are uniformly arranged exhibits more excellent wideband characteristics than the case in which the conductor patterns 110 and 120 of the cover 100 are non-uniformly arranged and the gain of the antenna is improved when the metal surfaces 400 are mounted.

In addition, referring to FIG. 11, it can be appreciated that the front back ratio is improved when the metal surfaces 400 are disposed.

That is, the metal wall surfaces 400 are mounted at the left and right sides of the feeding antenna 200, thereby improving the gain and front back ratio of the antenna.

Figure 12:
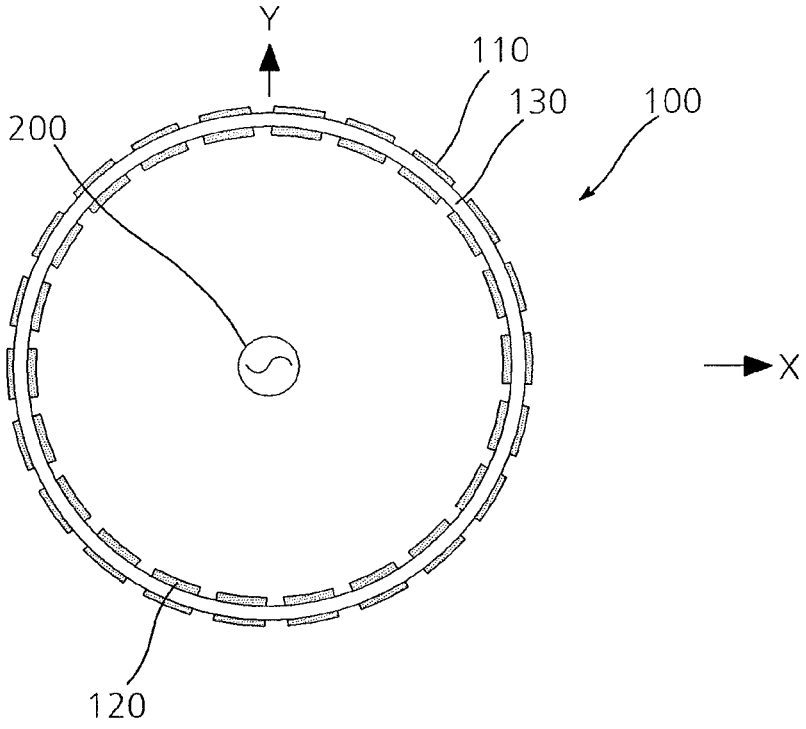
FIG. 12 is a diagram illustrating a structure of a high-gain wideband antenna apparatus in accordance with a third embodiment of the present invention.
Figure 13:
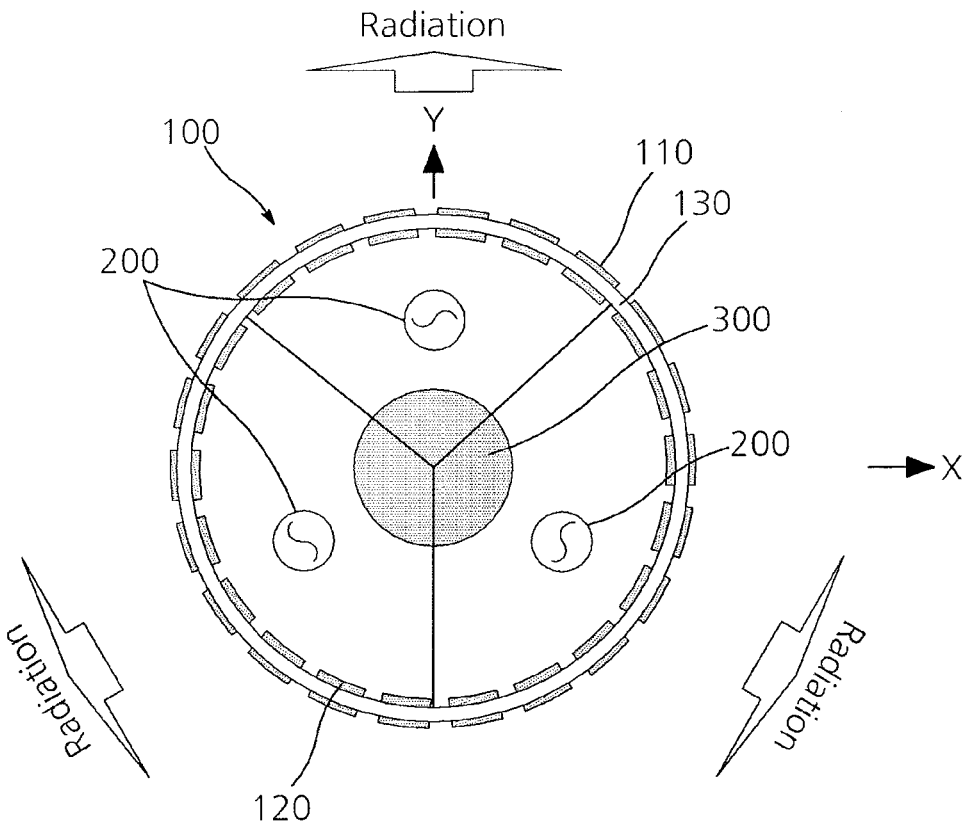
FIG. 13 is a diagram illustrating a structure of a high-gain wideband antenna apparatus in accordance with a fifth embodiment of the present invention.

FIG. 12 is a diagram illustrating a structure of a high-gain wideband antenna apparatus in accordance with a third embodiment of the present invention and FIG. 13 is a diagram illustrating a structure of a high-gain wideband antenna apparatus in accordance with a fifth embodiment of the present invention.

The first, second, and third embodiments of the present invention as described above describe, for example, the case in which the cover 100 may be implemented as a plane shape, but the cover 100 may also be implemented in a cylindrical shape.

That is, as illustrated in FIG. 12, the high-gain wideband antenna apparatus in accordance with the present invention may include the cover 100 including the conductive patterns 110 and 120 that are formed on the inner and outer surfaces of the cylindrical dielectric substrate 130 and one feeding antenna 200 that is disposed in the cover 100 to radiate the signal toward the conductive patterns 110 and 120 provided on the cover 100.

Alternatively, as illustrated in FIG. 13, the high-gain wideband apparatus in accordance with the present invention may be implemented as an antenna having a sector shape by including the cover 100 including the conductor patterns 110 and 120 that are formed in the inner and outer surfaces of the cylindrical dielectric substrate 130, the plurality of feeding antennas 200 each disposed in the plurality of areas partitioned in the cover 100, and the ground surface 300 that is disposed in a central area common to the plurality of areas to ground the feeding antennas 200.

Unlike this, the cover 100 is formed in a spherical shape (ball shape) and may be applied to the antenna apparatus.

As described above, according to the high-gain wideband apparatus in accordance with the present invention, in the antenna using the Fabry-Perot resonator, the conductor patterns are appropriately configured on both surfaces of the dielectric material to increase the gain and bandwidth of the antenna by controlling the phase of the reflection coefficient in the specific frequency band.

Further, it is possible to more extend the bandwidth of the antenna by uniformly configuring the size of the conductor patterns 110 and 120 and more increase the front back ratio of the antenna by additionally disposing the metal wall surfaces 400 at the sides of the feeding antenna 200.

In accordance with the embodiments of the present invention, the conductor patterns can be appropriately configured on both surfaces of the dielectric material in the antenna using the Fabry-Perot resonator to control the phase of the reflection coefficient in the specific frequency band, thereby increasing the gain and bandwidth of the antenna.

That is, in accordance with the embodiments of the present invention, the resonance conditions of the Fabry-Perot resonator can be satisfied even in the wide frequency band, thereby obtaining the high gain in the relatively wide frequency band.

In addition, in accordance with the embodiments of the present invention, the bandwidth of the antenna can be more extended by uniformly configuring the size of the conductive patterns and the front back ration of the antenna can be improved by additionally mounting the metal wall surfaces at the sides of the feeding antenna.

Although the embodiments of the present invention have been described in detail, they are only examples. It will be appreciated by those skilled in the art that various modifications and equivalent other embodiments are possible from the present invention. Accordingly, the actual technical protection scope of the present invention must be determined by the spirit of the appended claims.

What is claimed is:

1. A high-gain wideband antenna apparatus, comprising:

a feeding antenna configured to radiate a signal;

a cover configured to be disposed on a front surface of the feeding antenna based on a radiation direction of the signal and including conductor patterns formed on top and bottom surfaces of a dielectric substrate constituting the cover; and a ground surface configured to be disposed on a rear surface of the feeding antenna based on the radiation direction of the signal, wherein a thickness of the dielectric substrate is determined according to at least one of a bandwidth of a target frequency band, a magnitude of a reflection coefficient and a phase of the reflection coefficient.

2. The high-gain wideband antenna apparatus of claim 1, wherein the conductor patterns are each formed in different shapes.

3. The high-gain wideband antenna apparatus of claim 1, wherein the conductor patterns are formed by repeatedly arranging preset unit cells.

4. The high-gain wideband antenna apparatus of claim 3, wherein the conductor patterns are formed by non-uniformly arranging the sizes of the unit cells.

5. The high-gain wideband antenna apparatus of claim 1, further comprising: metal wall surfaces disposed at sides of the feeding antenna based on a radiation direction of the signal.

6. A high-gain wideband antenna apparatus, comprising:

a feeding antenna configured to radiate a signal; and covers each disposed on front and back surfaces of the feeding antenna based on a radiation direction of the signal and each including conductor patterns formed on top and bottom surfaces of a dielectric substrate constituting the cover, wherein a thickness of the dielectric substrate is determined according to at least one of a bandwidth of a target frequency band, a magnitude of a reflection coefficient and a phase of the reflection coefficient.

7. The high-gain wideband antenna apparatus of claim 6, wherein the conductor patterns are each formed in different shapes.

8. The high-gain wideband antenna apparatus of claim 6, wherein the conductor patterns are formed by repeatedly arranging preset unit cells.

9. The high-gain wideband antenna apparatus of claim 8, wherein the conductor patterns are formed by non-uniformly arranging the sizes of the unit cells.

10. The high-gain wideband antenna apparatus of claim 6, further comprising: metal wall surfaces disposed at sides of the feeding antenna based on a radiation direction of the signal.

11. A high-gain wideband antenna apparatus, comprising:

a cylindrical cover configured to include conductor patterns formed on inner and outer surfaces of a cylindrical dielectric substrate constituting the cylindrical cover; and a feeding antenna configured to be disposed in the cylindrical cover and radiate a signal toward the conductor patterns, wherein a thickness of the cylindrical dielectric substrate is determined according to at least one of a bandwidth of a target frequency band, a magnitude of a reflection coefficient and a phase of the reflection coefficient.

12. The high-gain wideband antenna apparatus of claim 11, wherein the conductor patterns are each formed in different shapes.

13. The high-gain wideband antenna apparatus of claim 11, wherein the conductor patterns are formed by repeatedly arranging preset unit cells.

14. The high-gain wideband antenna apparatus of claim 13, wherein the conductor patterns are formed by non-uniformly arranging the sizes of the unit cells.

15. A high-gain wideband antenna apparatus, comprising:

a cylindrical cover configured to include conductor patterns;

a plurality of feeding antennas configured to be each disposed in a plurality of areas partitioned in the cover to radiate a signal toward the conductor patterns; and a ground surface configured to be positioned at a central area common to the plurality of areas.

16. The high-gain wideband antenna apparatus of claim 15, wherein the conductor patterns are each formed in different shapes on inner and outer surfaces of a cylindrical dielectric substrate configuring the cover.

17. The high-gain wideband antenna apparatus of claim 15, wherein the conductor patterns are formed by repeatedly arranging preset unit cells.

18. The high-gain wideband antenna apparatus of claim 17, wherein the conductor patterns are formed by non-uniformly arranging the sizes of the unit cells.

19. The high-gain wideband antenna apparatus of claim 15, wherein each of the plurality of feeding antennas is disposed between the cylindrical cover and the ground surface.

* * * * *